US007614117B2

(12) United States Patent
Selvaraj

(10) Patent No.: US 7,614,117 B2
(45) Date of Patent: Nov. 10, 2009

(54) QUICK-RELEASE HINGE

(75) Inventor: Rajesh Selvaraj, Cary, NC (US)

(73) Assignee: Caterpillar S.A.R.L., Geneva (CH)

( * ) Notice: Subject to any disclaimer, the term of this patent is extended or adjusted under 35 U.S.C. 154(b) by 556 days.

(21) Appl. No.: 11/410,552

(22) Filed: Apr. 25, 2006

(65) Prior Publication Data

US 2007/0245522 A1 Oct. 25, 2007

(51) Int. Cl.
*E05D 7/10* (2006.01)

(52) U.S. Cl. ..... 16/258; 16/264

(58) Field of Classification Search ..... 16/258, 16/261, 264, 270, 382, 383, 384; 49/382; 312/326

See application file for complete search history.

(56) References Cited

U.S. PATENT DOCUMENTS

| | | | | | |
|---|---|---|---|---|---|
| 1,634,052 | A | * | 6/1927 | Ryan et al. | 16/338 |
| 2,778,053 | A | * | 1/1957 | Hess et al. | 16/258 |
| 3,410,599 | A | | 11/1968 | Kettler | |
| 3,734,076 | A | * | 5/1973 | Kiziol | 126/25 R |
| 3,747,273 | A | | 7/1973 | Johnson | |
| 3,934,925 | A | | 1/1976 | Fetsch | |
| 3,944,097 | A | | 3/1976 | Savage | |
| 4,102,011 | A | * | 7/1978 | Clack, Jr. | 16/261 |
| 4,131,970 | A | * | 1/1979 | Le Van | 16/270 |
| RE30,717 | E | * | 8/1981 | Dargene | 16/264 |
| 4,443,035 | A | | 4/1984 | Saemann | |
| 4,652,043 | A | | 3/1987 | Hurlburt | |
| 4,667,367 | A | * | 5/1987 | White et al. | 16/258 |
| 4,880,269 | A | | 11/1989 | Jensen et al. | |
| 4,986,593 | A | | 1/1991 | Lohmann | |
| 5,067,200 | A | * | 11/1991 | Stowell et al. | 16/237 |
| 5,076,637 | A | | 12/1991 | Larkin et al. | |
| 5,095,582 | A | * | 3/1992 | Ohlsson | 16/235 |
| 5,504,974 | A | | 4/1996 | Graber | |
| 5,615,918 | A | | 4/1997 | Ferrell | |
| 5,642,915 | A | | 7/1997 | Ackermann et al. | |
| 5,655,798 | A | | 8/1997 | Kaveney et al. | |
| 5,873,612 | A | | 2/1999 | Connor | |
| 6,247,746 | B1 | | 6/2001 | Brush | |
| 6,561,572 | B1 | | 5/2003 | Martin, Jr. | |
| 6,691,953 | B2 | | 2/2004 | Leclerc | |
| 6,811,209 | B2 | | 11/2004 | Woolett et al. | |

* cited by examiner

*Primary Examiner*—Chuck Y. Mah
(74) *Attorney, Agent, or Firm*—Richard K. C. Chang, II

(57) ABSTRACT

The quick-release hinge includes a first member, a second member, an actuation member, and a knuckle that may be attached to one of the first or second members. The first member may have a first locking element and a first abutment surface configured to abut a surface of an object. The second member may have a second locking element and a second abutment surface configured to abut a second surface of the object. The second locking element may be configured to attach to the first locking element in order to connect the hinge to an object. The actuation member may be attached to the first locking element so that when the actuation member is actuated, the first locking element may rotate about one revolution or less in order to detach from the second locking element and disconnect the hinge from the object.

20 Claims, 4 Drawing Sheets

QUICK-RELEASE HINGE

TECHNICAL FIELD

This invention relates generally to a quick-release hinge for use with doors, windows, and other hinged obstructions.

BACKGROUND

Machines, such as skid steer loaders, multi-terrain loaders, backhoe loaders, agricultural tractors, track-type tractors, articulated trucks, wheel loaders, and other types of construction, mining, or agricultural machinery are used for a variety of tasks requiring operator control. Typically, an operator controls these machines from an operator compartment.

For skid steer loaders, multi terrain loaders, and other compact machines, the operator compartment may include a door for sealing the operator compartment against unwanted dust, unconditioned air, and noise, all of which may contribute to operator fatigue. A typical door may include a window attached to a surrounding metal frame by a strip seal and hinges exterior to the operator compartment that pivotally attach the frame of the door to the operator compartment.

Despite the benefits of sealing the operator compartment against unwanted dust, unconditioned air, and noise, these components may hinder access to the interior of the operator compartment during repairs and in situations where objects may prevent the door from being pivoted to an open configuration. For example, when the bucket of a skid steer loader is disposed in a raised configuration, the bucket may prevent the door from being pivoted to the open configuration.

In order to provide access to the operator compartment in this situation, an operator or service person may remove the strip seal from around the window and then, remove the window. However, the strip seal and the window may be damaged during removal and may need to be replaced. Additionally, the metal frame may hamper entry and exit from the operator compartment.

Alternatively, the door may be removed by a service person while the operator waits in the operator compartment. However, this option may not be practical in the field and may require an inordinate amount of time.

The present invention is directed to overcome one or more of the problems as set forth above.

SUMMARY OF THE INVENTION

In one example of the present invention, a quick-release hinge is provided. The quick-release hinge includes a first member, a second member, an actuation member, and a knuckle that may be attached to one of the first or second members.

The first member may have a first locking element and a first abutment surface configured to abut a surface of an object.

The second member may have a second locking element and a second abutment surface configured to abut a second surface of the object. The second locking element may be configured to attach to the first locking element in order to connect the hinge to an object.

The actuation member may be attached to the first locking element so that when the actuation member is actuated, the first locking element may rotate about one revolution or less in order to detach from the second locking element and disconnect the hinge from the object.

In one aspect of the invention, the hinge may be used in a door assembly that permits the door to be quickly disconnected from a structure, such as a skid steer loader and other types of machines.

The door assembly may include a door having an interior surface and an exterior surface and a door handle assembly attached to the door.

The hinge may be disposed opposite the door handle assembly. The hinge may be connected to the door so that the first abutment surface may abut the interior surface of the door and the second abutment surface may abut the exterior surface of the door.

In another aspect of the invention, a method is provided for detaching an object from a structure where the object is connected to the structure by a hinge. The method may include the step of rotating a first locking element of the hinge about one revolution or less to detach the first locking element from a second locking element of the hinge. The method may also include the steps of removing the first member of the hinge from contact with the object and removing the second member of the hinge from contact with the object.

DETAILED DESCRIPTION

Figure 1:
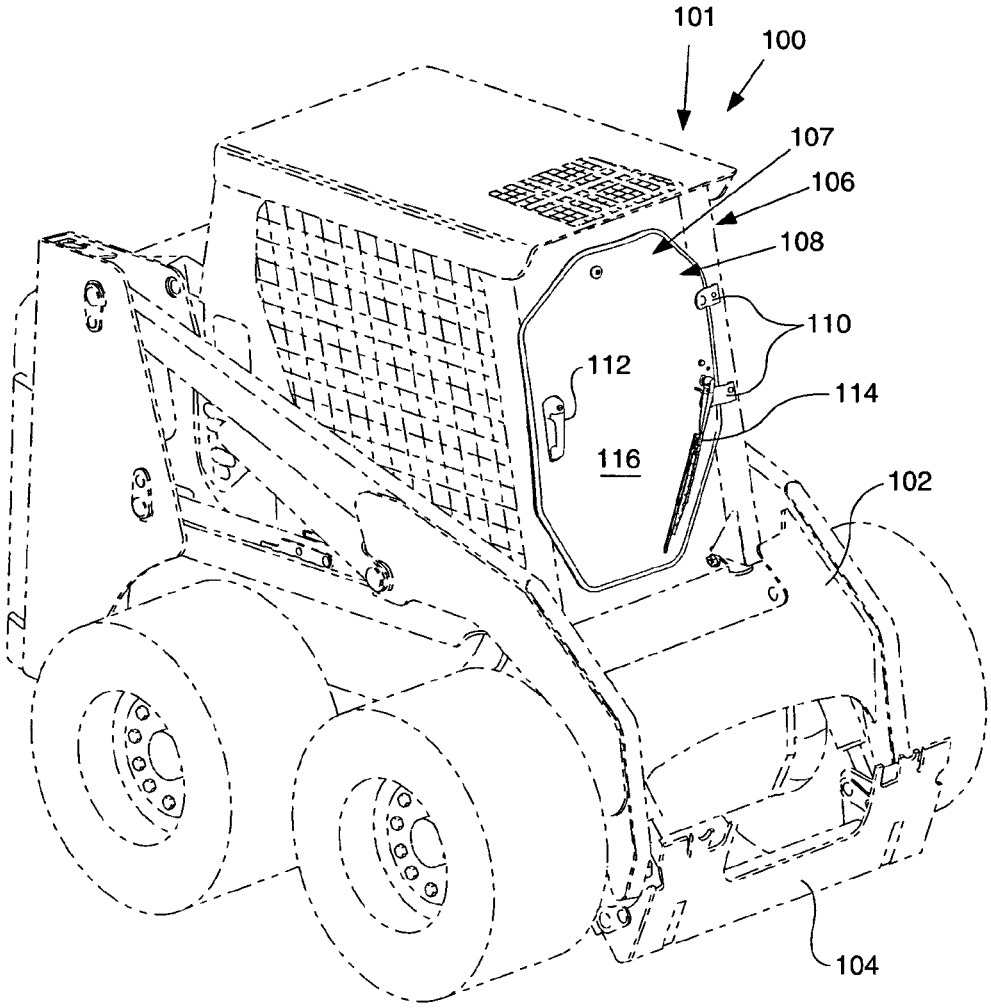
FIG. 1 is a perspective view of a machine having a door attached by quick-release hinges.

Referring to FIG. 1, a perspective view illustrates a structure 100, which may be a machine 101. The machine 101 may be a skid steer loader that may include an implement 102 having a coupler 104 for attaching tools known in the art (not shown) to the machine 101.

The machine 101 may also include an operator compartment 106 and an object 107 that may be a door 108. The door 108 may be pivotally attached to the operator compartment 106 by quick-release hinges 110. Of course, the quick-release hinges 110 may be used to pivotally attach other objects, such as a window or panel, to the machine 110 or other structures.

The door 108 may be frameless and may be made of a single sheet of tempered glass, polycarbonate, acrylic, or other transparent material known in the art. Of course, the door 108 may include a frame (not shown) and may be made from other materials, such as metals, plastics, and composites.

The door 108 may also include a door handle assembly 112 disposed remotely from the quick-release hinges 110 for securing the door 108 to the machine 101, and a wiper assembly 114 for cleaning an exterior surface 116 of the door 108.

When the implement 102 is raised, the implement 102 and the coupler 104 may prevent the door 108 from pivoting from the closed configuration to an open configuration. Consequently, the quick-release hinges 110 may be actuated to detach the door 108 from the operator compartment 106 in order to permit access to the interior of the operator compartment 106.

Figure 2:
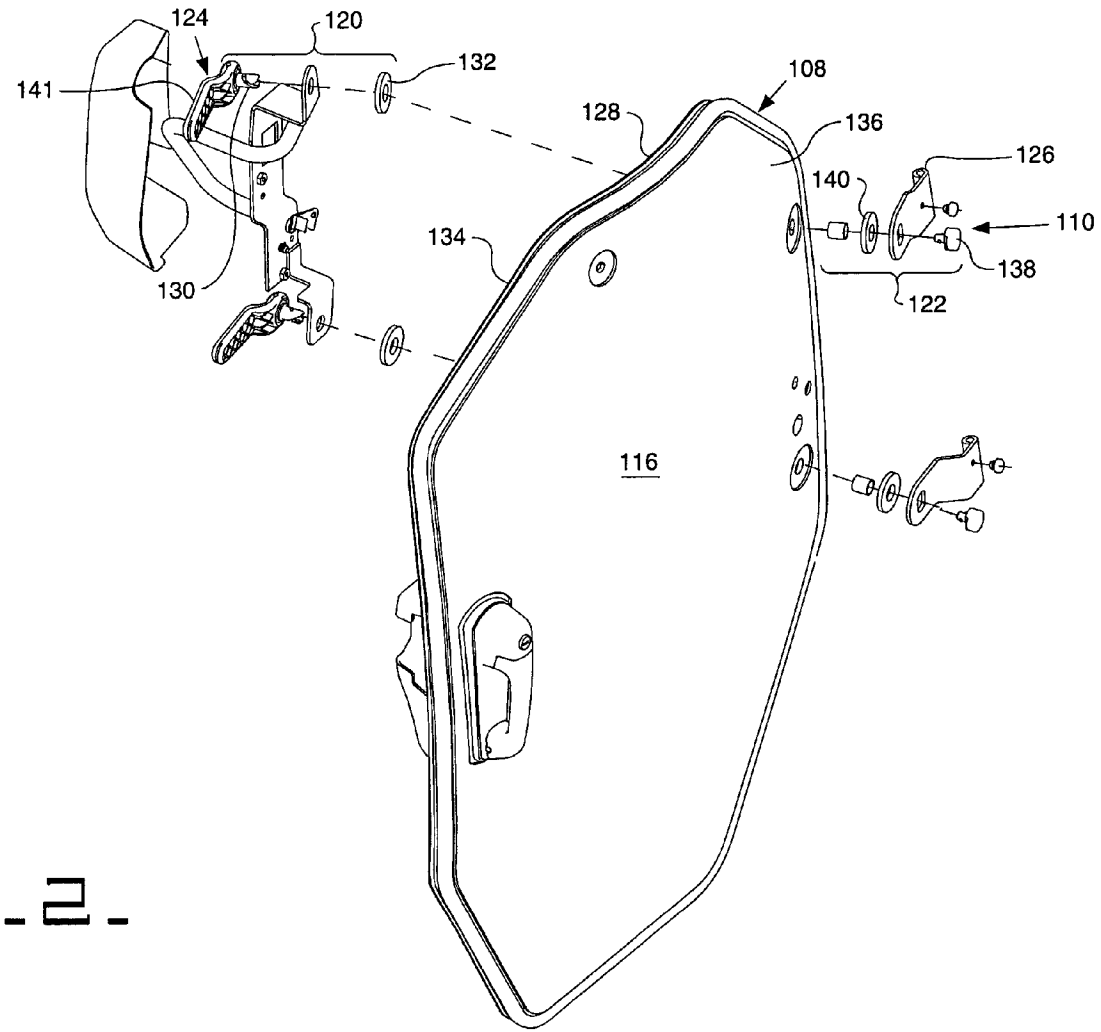
FIG. 2 is an exploded view of the door and quick-release hinges of FIG. 1.

Referring to FIG. 2, an exploded view illustrates the door 108 and quick-release hinges 110 of FIG. 1. Specifically, the quick-release hinges 110 each include a first member 120, a second member 122, an actuation member 124, and a knuckle 126.

As shown, the first member 120 may be disposed generally on an interior side 128 of the door 108. The first member 120 may include a first locking element 130 and a first abutment surface 132 for abutting an interior surface 134 of the door 108.

Conversely, the second member 122 may be disposed on an exterior side 136 of the door 108. The second member 122 may include a second locking element 138 and a second abutment surface 140 for abutting the exterior surface 116 of the door 108. The second locking element 138 may be attached to the first locking element 130 for securing the first member 120 to the second member 122 and to attach the quick-release hinge 110 to the door 108. Consequently, when the hinge 110 is attached to the door 108, the first member 120 abuts the interior surface 134 and the second member 122 abuts the exterior surface 116.

As shown, the knuckle 126 may be attached to or integrally formed with a component of the second member 122. Of course, the knuckle 126 may be attached to one of the first or second members 120, 122 and may be disposed on the interior side 128 or the exterior side 136 of the door 108.

The actuation member 124 may be a handle or button and may be attached to or integrally formed with a component of the first member 120. For example, the actuation member 124 may be a handle 141 integrally formed with the first locking element 130 as a unitary structure. Consequently, when the actuation member 124 is actuated, the first locking element 130 may be rotated about one revolution or less to detach from the second locking element 138 and disconnect the quick-release hinge 110 from the door 108. In some configurations, the first locking element 130 may be rotated about half of a revolution or less to detach from the second locking element 138 and disconnect the quick-release hinge 110 from the door 108, while in others, the first locking element 130 may be rotated about quarter of a revolution or less to detach from the second locking element 138 and disconnect the quick-release hinge 110 from the door 108.

Figure 3:
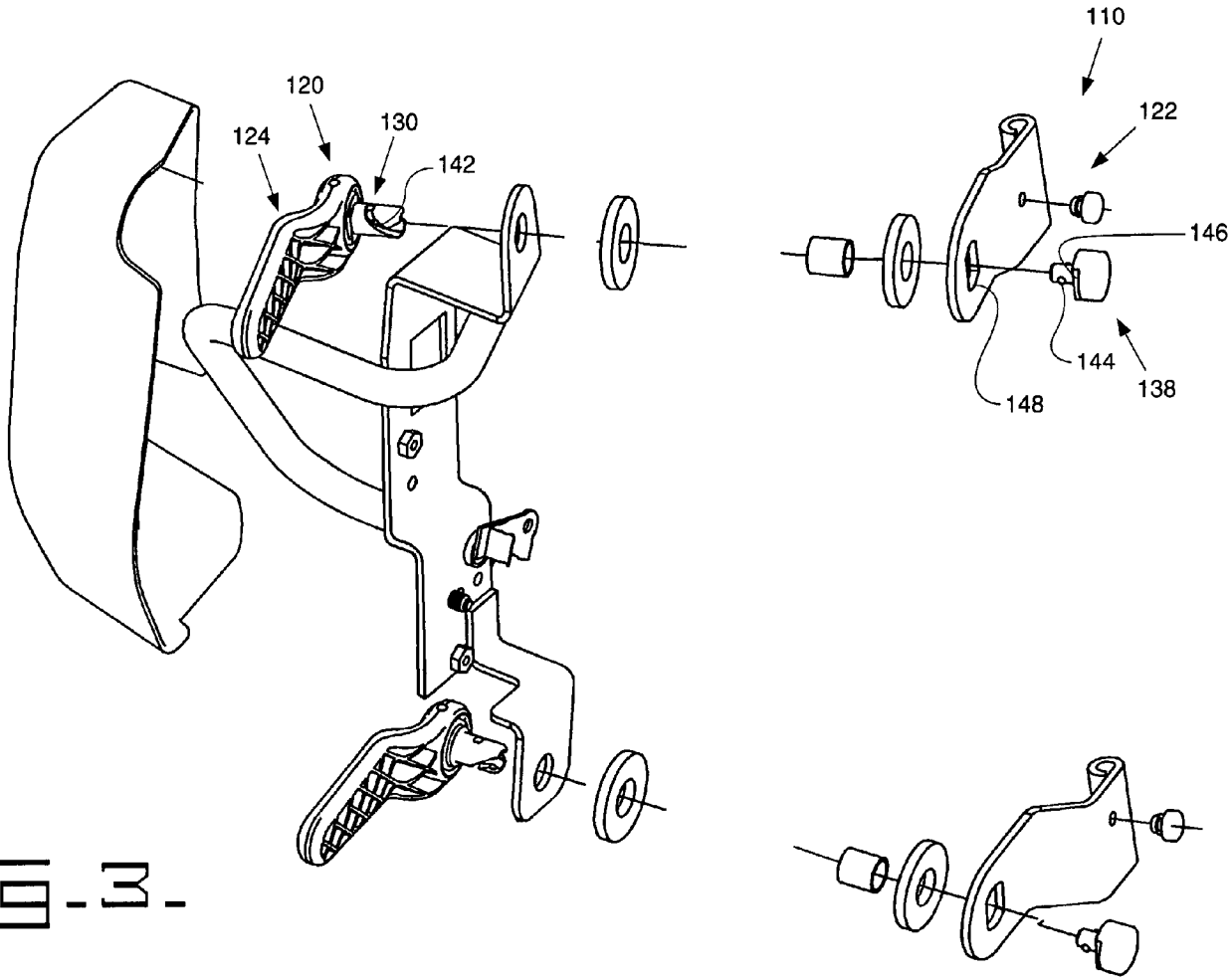
FIG. 3 is an exploded view of the quick-release hinges of FIG. 1.

Referring to FIG. 3, an exploded view further illustrates the quick-release hinges 110 of FIG. 1. As shown, the first locking element 130 may include a helical groove 142 shaped to receive a protrusion 144 of the second locking element 138, and the second member 122 may be configured to prevent the second locking element 138 from rotating. Consequently, when the actuation member 124 is actuated, the first locking element 130 is rotated relative to the second locking element 138 permitting the protrusion 144 to travel within the groove 142 to detach the first member 120 from the second member 122.

The second member 122 may be configured to prevent the second locking element 138 from rotating by disposing a noncircular cross section 146 of the second locking element 138 within a noncircular hole 148 in the second member 122.

Figure 4:
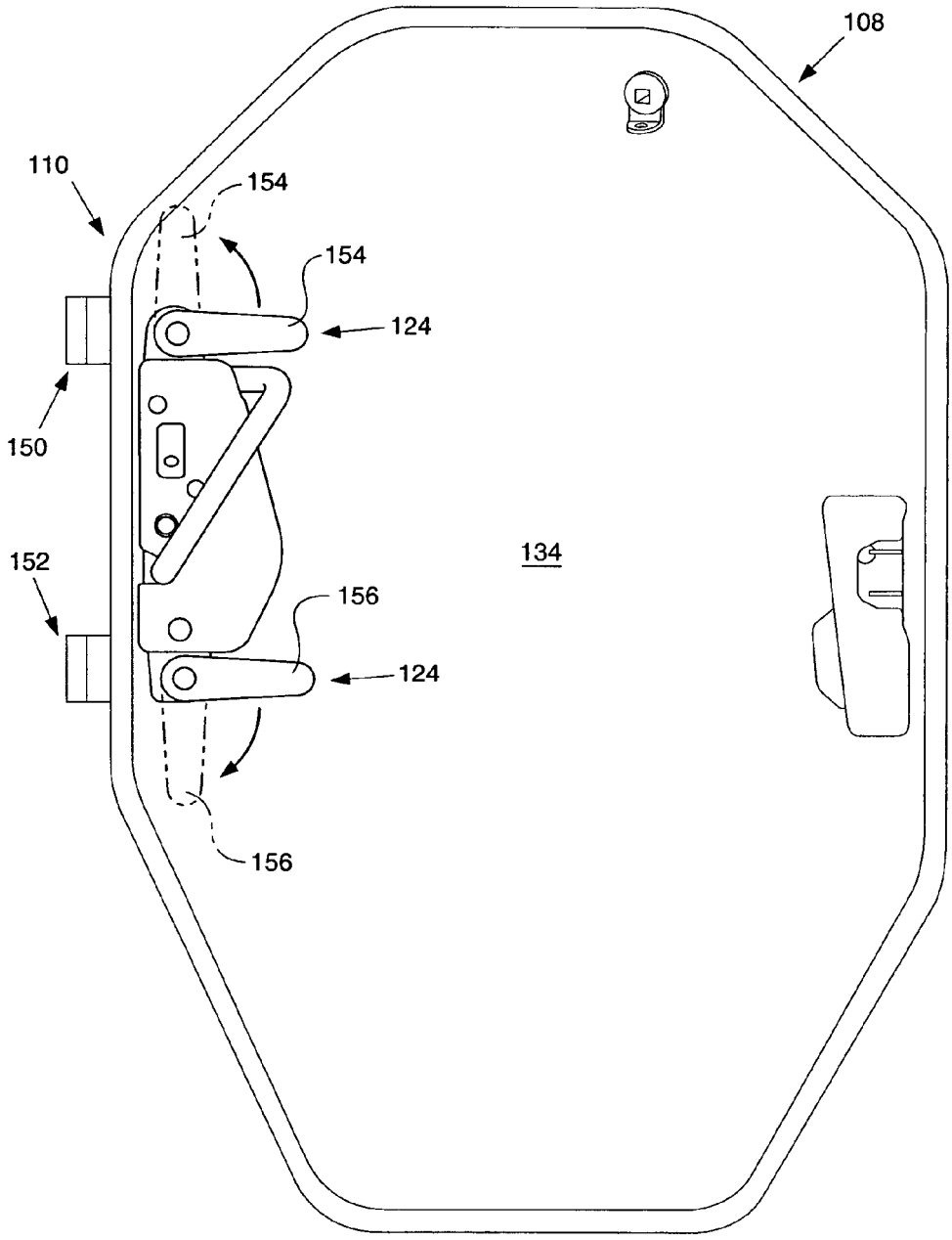
FIG. 4 is an elevated view of the interior surfaces of the door and quick-release hinges of FIG. 1.

FIG. 4 is an elevated view of the interior surface 134 of the door 108. As shown, a first and second hinge 150, 152 of the quick-release hinges 110 are attached to the door 108 and may include actuation members 124 disposed in an attached configuration. Specifically, the first and second hinges 150, 152 may respectively include a first handle 154 and a second handle 156.

As shown in phantom, the first and second handles 154, 156 may be actuated to a detached configuration by rotating the first handle 154 counter-clockwise and rotating the second handle clockwise 156. In other words, the second handle 156 may be rotated in a direction opposite to the rotation of the first handle 154. Additionally, the first and second handles 154,156 may be moved to the detached configuration by rotating each handle 154,156 about quarter of a revolution or less. By providing the handles 154,156 with different directions of rotation and by limiting the rotation of the handles to about one revolution or less, accidental actuation of both handles 154,156 is minimized while facilitating the purposeful actuation and detachment of the first and second hinges 150, 152 from the door 108.

Of course, the handles 154, 156 may have different configurations and thus, different directions of rotation or different numbers of revolution to move the hinges 110 from the attached configuration to the detached configuration.

INDUSTRIAL APPLICABILITY

A wide variety of machines, vehicles, and structures may have hinged objects attached, such as doors, windows, and covers, that need to be quickly detached in order to provide access to areas behind the object when ordinary pivoting of the hinged object is impractical. In such circumstances, the quick-release hinge may be utilized to quickly detach the object from the structure or machine.

For example, a method of utilizing the quick-release hinges 110 illustrated above and as shown in FIGS. 1-4 to detach the door 108 from the machine 101 may include the step of rotating the first handle 154 to rotate the first locking element 130 of the first hinge 150 about one revolution or less to detach the first locking element 130 from the second locking element 138 of the first hinge 150. The method may also include the steps of rotating the second handle 156 to rotate the first locking element 130 of the second hinge 152 about one revolution or less to detach the first locking element 130 from a second locking element 138 of the second hinge 152. Additionally, the second handle 156 may be rotated in a direction opposite to the rotation of the first handle 154.

Where the door 108 includes a door handle assembly 112, the method may include the step of actuating the door handle assembly to disconnect the door handle assembly from the machine 101.

Additionally, the method may include the steps of removing the first and second members 120,122 of the first and second hinges 150, 152 from contact with the door 108. Furthermore, where the first and second hinges 150, 152 include knuckles 126 pivotally attached to the machine 101 and connected to the second members 122 of the first and second hinges 150, 152, the method may further include the steps of pivoting the second members 122 of the first and second hinges 150, 152 relative to the machine 101 and moving the door 108 away from the machine 101.

It will be apparent to those skilled in the art that various modifications and variations can be made without departing from the scope or spirit of the invention. For example, an object may be attached to a structure with only one quick-release hinge 110 or more than two quick-release hinges 110. Additionally, other embodiments of the invention will be apparent to those skilled in the art from consideration of the specification and practice of the invention disclosed herein. It is intended that the specification and examples be considered as exemplary only.

What is claimed is:

1. A quick-release hinge comprising:

a first member including a first locking element and a first abutment surface configured to abut a surface of an object;

a second member including a second locking element and a second abutment surface configured to abut a second surface of the object, wherein the second locking element is configured to attach to the first locking element in a locked position;

an actuation member attached to the first locking element, wherein when the actuation member is actuated, the first locking element rotates about one revolution or less from the locked position, to detach from the second locking element and disconnect the hinge from the object; and a knuckle attached to one of the first or second members.

2. The quick-release hinge of claim 1, wherein the first locking element rotates about half of a revolution or less to detach from the second locking element and disconnect the hinge from the object.

3. The quick-release hinge of claim 1, wherein the first locking element rotates about quarter of a revolution or less to detach from the second locking element and disconnect the hinge from the object.

4. The quick-release hinge of claim 1, wherein the second member is configured to prevent the second locking element from rotating.

5. The quick-release hinge of claim 1, wherein one of the first locking element includes a helical groove extending a revolution or less about the first locking element.

6. The quick-release hinge of claim 1, wherein the first locking element includes a helical groove extending about quarter of a revolution or less about the first locking element, wherein the first locking element rotates about quarter of a revolution or less to detach from the second locking element and disconnect the hinge from the object.

7. The quick-release hinge of claim 1, wherein the actuation member is a handle, wherein the handle is limited to rotating one revolution or less.

8. The quick-release hinge of claim 1, wherein the actuation member is a handle, wherein the handle is limited to rotating about a quarter of a revolution or less.

9. A door assembly comprising:

a door having an interior surface and an exterior surface;

a door handle assembly attached to the door; and at least a first hinge disposed remotely from the door handle assembly including;

a first member having a first locking element and a first abutment surface abutting the interior surface of the door;

a second member including a second locking element and a second abutment surface abutting an exterior surface of the door, wherein the second locking element is attached to the first locking element in a locked position;

an actuation member attached to the first locking element, wherein when the actuation member is actuated, the first locking element rotates about one revolution or less to detach from the second locking element and disconnect the hinge from the door; and a knuckle attached to one of the first or second members.

10. The door assembly of claim 9, wherein the first locking element rotates about quarter of a revolution or less to detach from the second locking element and disconnect the hinge from the object.

11. The door assembly of claim 9, wherein the second locking element has a noncircular cross section disposed within a noncircular hole in the second member, wherein the second locking element is prevented from rotating relative to the second member.

12. The door assembly of claim 9, further comprising a second said hinge, wherein the actuation member is a first handle and the second hinge comprises a second handle that rotates in a direction opposite to the rotation of the first handle.

13. The door assembly of claim 9, wherein the first locking element comprises a helical groove extending a revolution or less about the first locking element and is configured to engage a protrusion of the second locking element.

14. A method for detaching an object from a structure, wherein the object is connected to the structure by a hinge, the hinge comprising a first member having a first locking element and a second member having a second locking element, wherein the first locking element is attached to the second locking element to attach the hinge to the object, the hinge further including an actuation member attached to the first locking element in a locked position, the method comprising:

actuating the actuation member to rotate the first locking element of the hinge about one revolution or less from the locked position, to detach the first locking element from the second locking element of the hinge;

removing the first member of the hinge from contact with the object; and removing the second member of the hinge from contact with the object.

15. The method of claim 14, wherein the object is a door having an interior surface and an exterior surface, wherein the first member of the hinge abuts the interior surface and the second member of the hinge abuts the exterior surface.

16. The method of claim 14, wherein the hinge comprises a knuckle pivotally attached to the structure and connected to the second member, the method further comprising pivoting the second member relative to the structure.

17. The method of claim 14, wherein the actuation member is a first handle attached to the first locking element, wherein the object is connected to the structure by a second hinge, the second hinge comprising a second handle, wherein actuating the actuation member, the first handle is rotated, the method further comprising rotating the second handle in a direction opposite to the rotation of the first handle to detach the second hinge from the object.

18. The method of claim 14, wherein the actuation member is a handle, wherein actuating the actuation member includes rotating the handle about a quarter of a revolution or less to detach the first locking element from the second locking element.

19. The method of claim 14, wherein the object is a door, the door includes a door handle assembly attached to the door, the method further comprising actuating the door handle assembly to disconnect the door handle assembly from the structure.

20. The method of claim 19, wherein the structure is a machine.

* * * * *